US005195485A

United States Patent [19]

Jensen et al.

[11] Patent Number: 5,195,485

[45] Date of Patent: Mar. 23, 1993

[54] LOW EMISSION CYLINDER CUT-OUT IDLE SYSTEM

[75] Inventors: Scott P. Jensen; Mitchell J. Gillispie, both of Tacoma; Robert A. McLean, Puyallup, all of Wash.

[73] Assignee: Energy Conversions, Inc., Tacoma, Wash.

[21] Appl. No.: 871,550

[22] Filed: Apr. 21, 1992

[51] Int. Cl.[5] ..... F02B 77/00

[52] U.S. Cl. ..... 123/198 F

[58] Field of Search ..... 123/198 F

[56] References Cited

U.S. PATENT DOCUMENTS 1,898,602 2/1933 Stomsvik ..... 123/198 F 4,492,191 1/1985 Aoki et al. ..... 123/198 F

*Primary Examiner*—Noah P. Kamen

*Attorney, Agent, or Firm*—Leo Gregory

[57] ABSTRACT

The invention is directed to reducing unburned hydrocarbons during engine idling. During idling, one cylinder bank of an engine is alternately deactived by fuel cut-off structure with another cylinder bank. Therefore, one bank works twice as hard and consequently produces much lower emissions. A timer alternates between the cylinder banks anywhere from fifteen seconds to four minutes.

5 Claims, 2 Drawing Sheets

LOW EMISSION CYLINDER CUT-OUT IDLE SYSTEM

BACKGROUND OF THE INVENTION

1. Field of Invention

The above entitled structure relates to the automatic control of the engine of a locomotive in an idling mode to control the number of cylinders in operation to reduce smoke emission.

2. Brief Description of the Previous Art

The use of dual fuels such as of the alternate use of diesel or liquified natural gas in the operation of a locomotive is a fairly new development. However it has been found that in a dual fuel operation, a lower compression engine is used with beneficial operating results but with a resulting lower compression ratio piston being used at idle speeds, a smoke emission condition arises. This results from the presence of unburned hydrocarbons.

It is the purpose herein to reduce materially or eliminate altogether smoke emissions not only with dual fueled engines but also with diesel operated engines.

SUMMARY OF THE INVENTION

The structure herein relates to the control of fuel injection and engine operation in connection with a dual fuel operated locomotive engine and in connection with other dual fuel and diesel operated engines.

The purpose herein is to provide a structure which is particularly adapted to reduce or eliminate smoke emissions resulting from unburned hydrocarbons due to the presence of a lower compression ratio piston which is present with a converted dual fuel operated engine.

The structure herein is coordinated with the throttle indicated speed of a locomotive whereby when engine speed does not exceed the throttle indicated idle speed, there automatically results a reduction in the number of cylinders of the engine in operation whereby the remaining operating cylinders are forced to work harder and thus burn more efficiently the fuel fed to them and thus reduce significantly the level of unburned hydrocarbons and the amount of smoke emissions.

These and other objects and advantages will be set forth in the following description in connection with the accompanying drawings in which like reference numerals or characters refer to similar parts throughout the several views.

DESCRIPTION OF A PREFERRED EMBODIMENT

Figure 1:
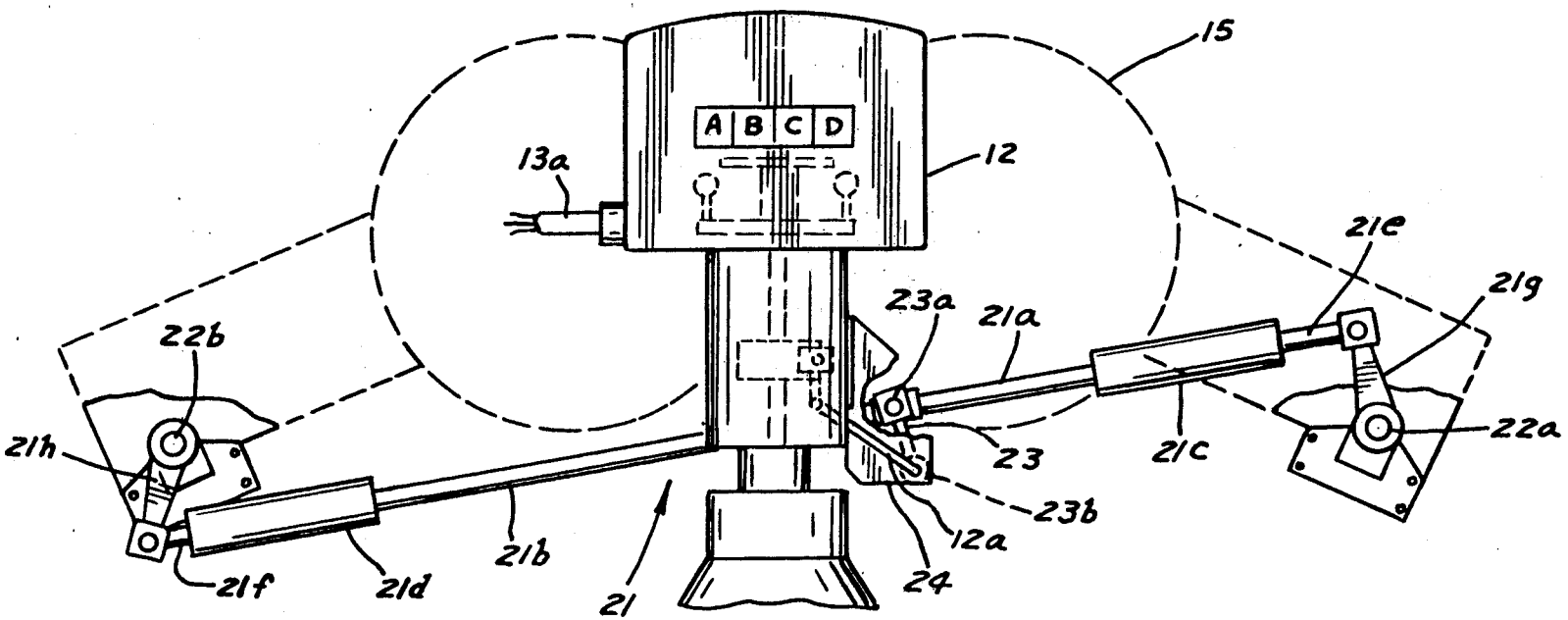
FIG. 1 is a broken view in front elevation with an outline of an engine in elevation dotted therebehind.

As will be further described, the invention herein is particularly adapted to reduce the smoke emissions of a diesel or dual fuel engine of a locomotive by affecting the operation of the engine in reducing the number of cylinders in operation at an idle speed and thus, as will be explained, reduce its level of unburned hydrocarbons.

The arrangement herein described is in connection with a dual fuel locomotive engine. Locomotive engines have multiple cylinders ranging as from six to twenty per engine. The cylinders are divided into two transversely spaced parallel banks having an equal number of cylinders in each bank The number of cylinders and the per cylinder displacement does not effect the application of the invention herein The basic concept here is to eliminate fuel from one half of the cylinders of the engine, or in other words, cutting out one bank of cylinders on a timed alternating basis, thus forcing the remaining operating cylinders to carry the full load of driving the locomotive at an idling speed, that is, to work harder and be caused to burn fuel more efficiently and as a result reduce the level of unburned hydrocarbons and in addition also reduce relative fuel consumption The engine speed of a locomotive is controlled by a governor, as will further be described. The governor has two types of input, namely, a rotary mechanical input direct from the engine and an electrical input from the locomotive operator's throttle handle contacts The governor is a conventional item of equipment and the inventive structure herein is activated by the governor in the course of its normal and customary operation.

The governor will be described sufficiently to provide a good understanding of its working association with the inventive control structure herein Referring to the drawings and particularly to FIG. 1, indicated is a governor 12 and in connection with the electrical operation thereof and contained therein are electrical solenoids A–D which are in circuit with a series of electrical contacts 1–8 which form the positioning notches for the throttle handle 14 as shown mounted on a fixture 14*a*. This handle, remote from the governor, is operated by the locomotive operator in the cab of the locomotive, not shown. The governor 12 is mounted adjacent the engine of the locomotive, the engine being indicated by dotted line at 15.

Figure 2:
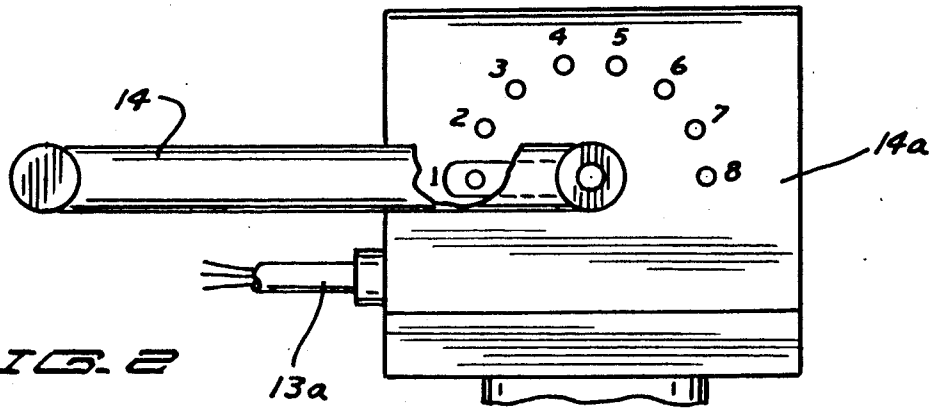
FIG. 2 is a broken view in elevation showing a throttle handle and its positions.
Figure 3:
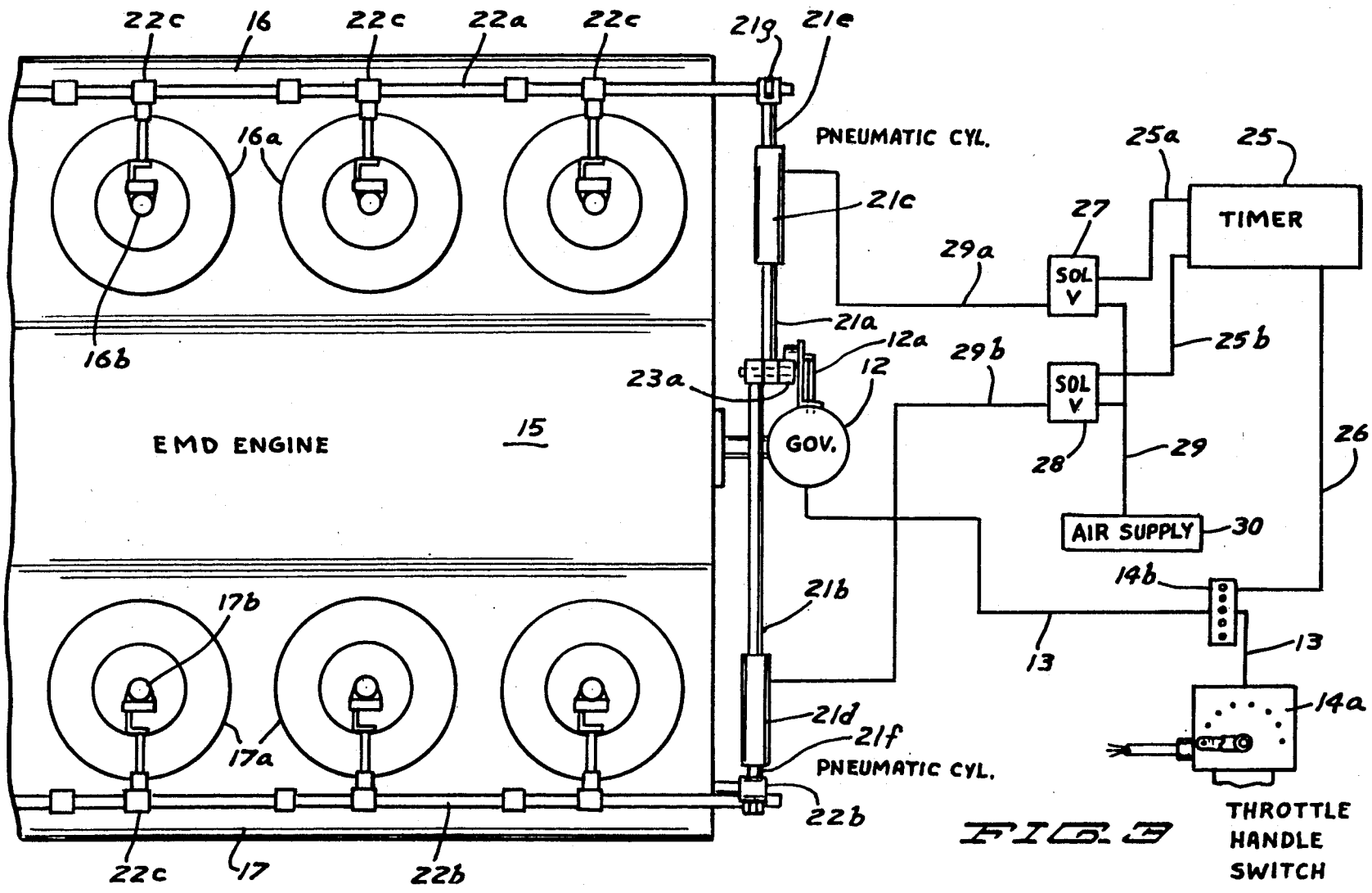
FIG. 3 is a top plan view partially schematic and partially diagrammatic.

The circuitry connecting said solenoids of said governor and said throttle handle contacts is by a line 13 as shown in FIG. 3 and indicated by the wire harness 13*a* in FIGS. 1 and 2. The power source is conventional.

The governor has a mechanical input in addition to an electrical input. The mechanical input is by a shaft extending into the governor for operation of a control therein and the shaft is driven through a gear train by the crankshaft of the engine. This part is conventional structure in the operation of a locomotive and is not here shown.

The electrical input is from the solenoids and when the engine speed is not more than that indicated by the first throttle handle contact, which is idle speed, the electrical input ceases and this triggers the control assembly to be hereinafter described. The engine speed is determined or controlled by the operation of the throttle handle through its several contacts 1–8. The governor is in communication through its solenoids with the throttle handle setting or position and controls in a conventional manner the fuel supply to the cylinders.

The engine as indicated in FIG. 3 has two banks 16 and 17, of cylinders, 16*a* and 17*a*, shown diagrammatically. The number and displacement of the cylinders is not material herein.

The control assembly to be described is the operating linkage which senses when the locomotive is at idle speed and disables or overrides the normal fuel supply control mechanism to cause the fuel supply mechanism on an alternating basis to cease supplying one bank of cylinders and cause the fuel which would otherwise be supplied to both banks of cylinders to be supplied to the other of the banks of cylinders on a timed alternating basis.

The fuel control assembly comprises a two part shaft 21 having parts 21a and 21b secured at their adjacent overlapping ends by the connecting head or clevis portion 23a of a lever arm 23 having a rounded bottom portion 23b at its lower end supported on a bracket 24. Said bottom is secured to and fixed to the end of a shaft 12a which extends into the governor to be actuated with appropriate linkage by a power piston originating in the governor in controlling the fuel supply to the cylinders by causing linear movement of said shaft 21. The controls are very precise and the precise amount of movement is very little.

The detail of structure in and from the governor in operating said lever arm 23 is conventional and well established in the art and thus is not here shown.

Conventionally the shaft 21 would have its respective outer ends pivoted to the short length links 21g and 21h to cause the same to rotate shafts 22a and 22b to be described.

However in connection with the control assembly herein, said shaft 21 is modified to the extent of having pneumatic cylinders 21c and 21d mounted onto the ends thereof and the respective pistons 21e and 21f of said cylinders extend to be pivotally secured to the adjacent ends of said links 21g and 21h. Said links are rigidly secured to the adjacent ends of fuel injection control shafts 22a and 22b which are at right angles to the shaft 21 and extend in transversely spaced parallel relationship along said banks of cylinders 16a and 17a.

Extending from each of said shafts 22a and 22b to be operatively connected to the supply valve inlets 16b and 17b of each cylinder as indicated is a fuel injection supply control member or valve 22c which functions in a known conventional manner.

The linear movement of the shaft portions 21a and 21b taken with the pistons of the pneumatic cylinders 21c and 21d causes the rotation of the said shafts 22a and 22b sufficiently to actuate the controls of the conventional fuel injection control members 22c.

With continued reference to FIG. 3, in connection with the addition of the pneumatic cylinders 21c and 21d to the shaft 21, further elements of the control structure will be described.

Shown schematically is a conventional control timer 25 which by means of a line 26 is indicated as being in electrical contact with the throttle handle contacts 1–8 and with the solenoids A–D in the governor 12 by means of a terminal block 14b. The solenoids in the governor being in circuit with the throttle handle contacts give the indication when the engine speed of the locomotive is at idle speed. Signals from the solenoids are diode isolated whereby the timer 25 is able to monitor the governor but cannot affect its operation. When at idle speed, the electrical input from the solenoids to the throttle handle contacts ceases and this alerts and actuates or triggers the timer to commence its operation.

Now as shown in FIG. 3, the timer is in circuit with solenoid valves 27 and 28 by means of lines 25a an 25b and running through said solenoids and controlled thereby is an air line 29 having a segment 29a through the solenoid 27 to the pneumatic cylinder 21c and having a segment 29b running through the solenoid 28 to the pneumatic cylinder 21d, said air line commencing with an appropriate pressurized air supply 30.

Thus as indicated, when the locomotive engine is in an idle speed mode and the electrical inputs drop out of the throttle handle contacts, the timer sensing the idle mode of speed becomes activated from monitoring to putting the control arrangement herein into effect.

This operation begins with the timer activating one of the solenoid valves 27 or 28. For example, the valve 27 upon becoming activated provides for the air supply through the line 29a to pass through to the cylinder 21c. The injection of this air pressure disables or overrides the otherwise normal control of this cylinder by action of the governor 12 and causes the action of said piston 21e to rotate the shaft 22a to cause all of the controls 22c to close the valves 16b and put to a no fueling position the cylinders 16a. The fuel which otherwise would be fed to the cylinders 16a is diverted to the cylinders 17a. This is not shown but is by means of a conventional procedure.

This operation alternates putting at rest in turn the cylinders 16a and 17a on a timed basis such as of 15 second intervals up to four minute intervals. Thus then one bank of cylinders will be caused to labor twice as hard to maintain the idle speed and this results in a more efficient combustion of the hydrocarbons in the fuel whereby the exhaust of unburned hydrocarbons for all practical purposes is no longer present and the exhaust from the locomotive no longer pollutes the outside air as formerly. Thus the emission of smoke from the locomotive in view of the operation herein is practically non-existent.

This operation continues so long as the locomotive is at an idle speed and disables instantly when the engine returns to an operating speed in excess of an idle speed.

The operation herein has proved to be very successful and very satisfactory. Thus it is seen that there has been provided a very simple yet effective automatically actuated control for the reduction or elimination of smoke control in the operation of a diesel or dual fueled locomotive engine.

It will of course be understood that various changes may be made in form, details, arrangement and proportions of the parts without departing from the scope of the invention herein which, generally stated, consists in an apparatus capable of carrying out the objects above set forth, in the parts and combination of parts disclosed and defined in the appended claims.

What is claimed is:

1. An automatically actuated dual fuel low emission idle structure for a locomotive engine in circuit with the engine throttle contacts which determine the operation of the governor of said engine, comprising a timer in circuit with said contacts of said throttle to monitor the same, a pair of solenoid valves in circuit with said timer, an air line running to each of said solenoid valves, a shaft, a pneumatic cylinder integral with each end portion of said shaft with each cylinder having a piston to in effect respectively extend said end portions of said shaft, said air lines respectively extending to said pneumatic cylinders from said solenoids, said engine having two banks of cylinders, a fuel injection control shaft along each of said banks of cylinders at right angles to said shaft, and pivot members respectively connecting the ends of said first mentioned shaft with the adjacent ends of said fuel injection control shafts whereby an extension of an end portion of said first mentioned shaft causes the rotation of a corresponding of said second mentioned shafts to shut off the fuel supply valves to a corresponding bank of said cylinders.

2. The structure of claim 1, whereby said timer becomes actuated upon sensing from said throttle handle contacts when said locomotive engine is at an idle speed, one of said solenoids being caused by said timer to open an air line extending therethrough, and said air line actuates its corresponding pneumatic cylinder to cause the rotation of the corresponding fuel injection control shaft.

3. The structure of claim 1, whereby said timer alternately causes said solenoids to open their respective air lines and actuate their respective pneumatic cylinders.

4. The structure of claim 1, whereby said timer becomes deactivated automatically upon sensing from said throttle contacts that said locomotive engine has resumed operation at a speed in excess of an idling speed.

5. An automatically actuated low emission idle structure for a locomotive engine in circuit with the engine throttle contacts, comprising a locomotive engine, a throttle handle having contacts in connection with said engine to manage the speed thereof, a timer in circuit with said throttle contacts adapted to monitor the same, a pair of solenoids in circuit with said timer, an air line running to each of said solenoids, a control shaft, a pneumatic cylinder at each end of said shaft having outwardly extendable pistons, from said solenoids, said engine having two banks of cylinders, a fuel injection control shaft along each of said banks of cylinders at right angles to said shaft, and pivot members respectively connecting the adjacent ends of said fuel injection control shafts whereby an extension of one of said pistons causes the rotation of a corresponding of said injection control shafts to shut off the fuel supply valves to a corresponding bank of said cylinders.

* * * * *